US008678372B2

(12) United States Patent
Yasukawa

(10) Patent No.: US 8,678,372 B2
(45) Date of Patent: Mar. 25, 2014

(54) MEDIUM FEEDING DEVICE

(71) Applicant: PFU Limited, Kahoku (JP)

(72) Inventor: Ryoichi Yasukawa, Ishikawa (JP)

(73) Assignee: PFU Limited, Kahoku-Shi, Ishikawa (JP)

( * ) Notice: Subject to any disclaimer, the term of this patent is extended or adjusted under 35 U.S.C. 154(b) by 0 days.

(21) Appl. No.: 13/763,070

(22) Filed: Feb. 8, 2013

(65) Prior Publication Data

US 2013/0241145 A1 Sep. 19, 2013

(30) Foreign Application Priority Data

Mar. 19, 2012 (JP) ..... 2012-062370

(51) Int. Cl.
*B65H 5/00* (2006.01)
*B65H 3/52* (2006.01)

(52) U.S. Cl.
USPC ..... 271/10.09; 271/10.11; 271/125; 271/122

(58) Field of Classification Search
USPC ..... 271/4.09, 4.1, 10.09, 10.11, 10.13, 125, 271/122
See application file for complete search history.

(56) References Cited

U.S. PATENT DOCUMENTS

| | | | | |
|---|---|---|---|---|
| 5,664,771 | A | 9/1997 | Nagatani et al. | |
| 6,565,079 | B1 | 5/2003 | Kakegawa et al. | |
| 6,913,257 | B2 | 7/2005 | Takaki et al. | |
| 7,481,421 | B2 * | 1/2009 | Tsukamoto et al. | 271/110 |
| 2006/0214356 | A1 | 9/2006 | Yasukawa et al. | |
| 2009/0256304 | A1 * | 10/2009 | Koizumi et al. | 271/10.09 |
| 2012/0153558 | A1 * | 6/2012 | Takahashi | 271/10.09 |

FOREIGN PATENT DOCUMENTS

| | | | |
|---|---|---|---|
| JP | 2502264 | B2 | 5/1996 |
| JP | 8-217274 | A | 8/1996 |
| JP | 11-193141 | A | 7/1999 |
| JP | 2002-002993 | A | 1/2002 |
| JP | 2003-276891 | A | 10/2003 |
| JP | 3660547 | B2 | 6/2005 |
| JP | 4395085 | B2 | 1/2010 |

* cited by examiner

*Primary Examiner* — David H Bollinger
(74) *Attorney, Agent, or Firm* — McDermott Will & Emery LLP

(57) ABSTRACT

A medium feeding device 1 includes a separating power generating device 7 which causes a brake roller 4 to generate a rotational load in a direction counter to a conveying direction. The device 7 includes a torque limiter 17 which generates a load of a predetermined upper limit torque T1, a torque limiter 18 which is arranged in series with the torque limiter 17 on a power transmission path to the brake roller 4 and generates a load of an upper limit torque T2 smaller than the torque T1, and an electromagnetic clutch 22 which switches between connection and disconnection between the power transmission path and a bypass route which bypasses the torque limiter 18. The device 7 can change the rotational load of the brake roller 4 to the torque T1 or the torque T2 by the switching of the electromagnetic clutch 22.

7 Claims, 6 Drawing Sheets

MEDIUM FEEDING DEVICE

CROSS-REFERENCE TO RELATED APPLICATIONS

The present application is based upon and claims the benefit of priority from Japanese Patent Application No. 2012-062370 filed in Japan on Mar. 19, 2012. The entire contents of which are incorporated herein by reference.

BACKGROUND OF THE INVENTION

1. Field of the Invention

The present invention relates to a medium feeding device.

2. Description of the Related Art

Conventionally, a medium feeding device is known that supplies one medium as a transportation target one by one from among a plurality of stacked media. The medium feeding device can separate the medium of one sheet as a transportation target from other media and sequentially convey it, by introducing the medium between a feeding roller, which conveys the medium in a conveying direction, and a brake roller, which generates rotational load in a direction counter to the conveying direction.

In such a medium feeding device, it is desirable to avoid a paper feed failure and a double feed even when a variety of media which differ in friction characteristics or strength are used. For example, Japanese Patent No. 3660547 discloses a technology which appropriately changes a rotational load of a brake roller by controlling an electromagnetic brake. In this way, suitable rotational load can be set for each of a variety of media. This contributes to avoidance of fault, such as a double feed.

Incidentally, there is the demand for improvement in medium conveying speed of a medium feeding device to increase business efficiency or cost performance. In order to secure sufficient performance of separating a medium as a transportation target from the other media when the medium feeding device operates at a high medium conveying speed, it is necessary for a brake roller to generate a rotational load as promptly as possible when a paper feed failure or double feed occurs.

However, in the conventional technologies disclosed in Japanese Patent No. 3660547, in general an element with large inertia, such as an electromagnetic brake, is used to change the rotational load. For this reason, when the medium conveying speed is made higher, a response at the time of the brake roller generating the rotational load is deteriorated due to the influence of the inertia of the element that changes the rotational load. Therefore, in such a case, there is a risk that a medium as a transportation target cannot be reliably separated from the other media.

SUMMARY OF THE INVENTION

The present invention is directed to a medium feeding device that eliminates the risk.

One aspect of the present invention relates to a medium feeding device. The medium feeding device includes a feeding roller that conveys a medium in a conveying direction, a brake roller arranged to be in pressure contact with the feeding roller, and a rotational load generating unit that is connected to the brake roller and causes the brake roller to generate a rotational load in a direction counter to the conveying direction.

The rotational load generating unit includes a first load generating unit that is directly connected to the brake roller and generates a load of a first predetermined torque based on a driving power generated by a driving source, and a second load generating unit that is arranged in series with the first load generating unit on a power transmission path along which the rotational load is transmitted to the brake roller, and that generates a load of a second torque smaller than the first torque. The rotational load generating unit further includes a switching unit that is connected to the first load generating unit side rather than the second load generating unit side on the power transmission path and switches between connection and disconnection between the power transmission path and a bypass route which bypasses the second load generating unit.

The rotational load of the brake roller can be changed to the first torque or the second torque by the switching of the switching unit.

DETAILED DESCRIPTION OF THE PREFERRED EMBODIMENTS

Hereinbelow, embodiments of a medium feeding device according to the present invention are described based on the drawings. In the following drawings, the same reference signs denote the same or equivalent portions, and the description thereof is not repeated.

First Embodiment

Figure 1:
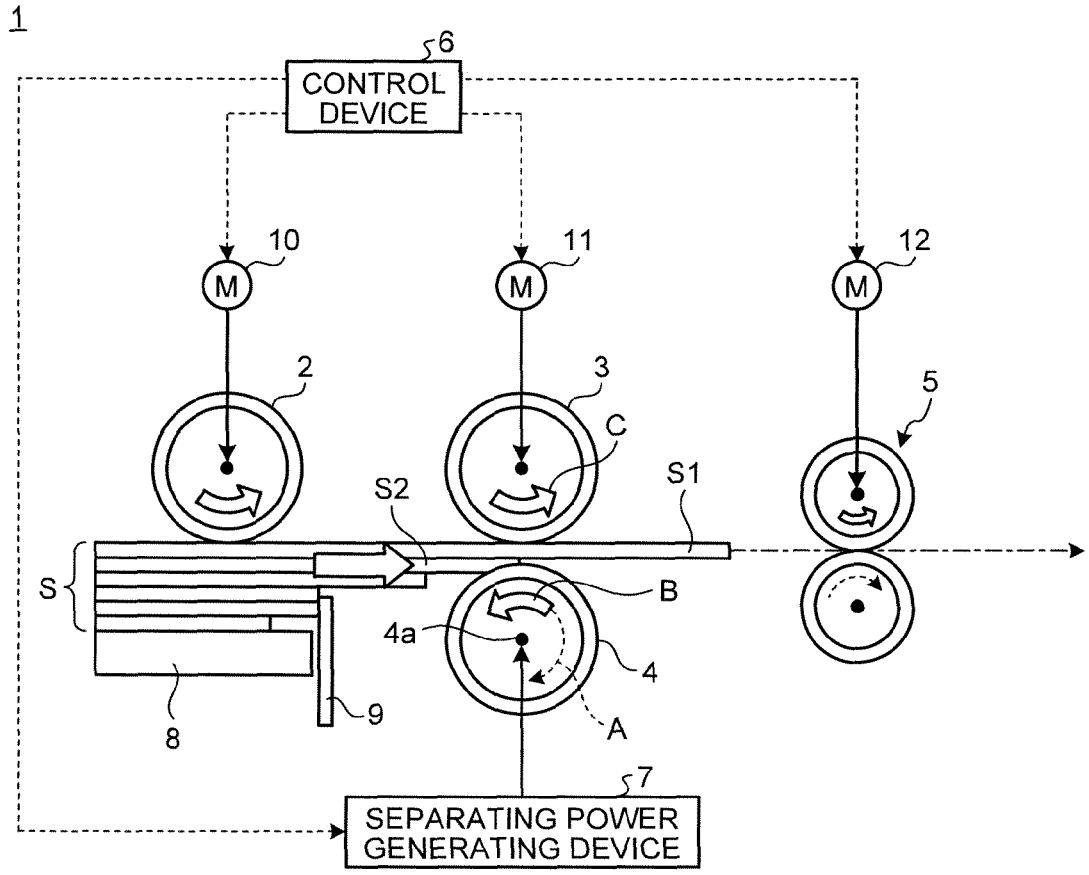
FIG. 1 is a cross-sectional view that illustrates a schematic configuration of a medium feeding device according to a first embodiment of the present invention.
Figure 2:
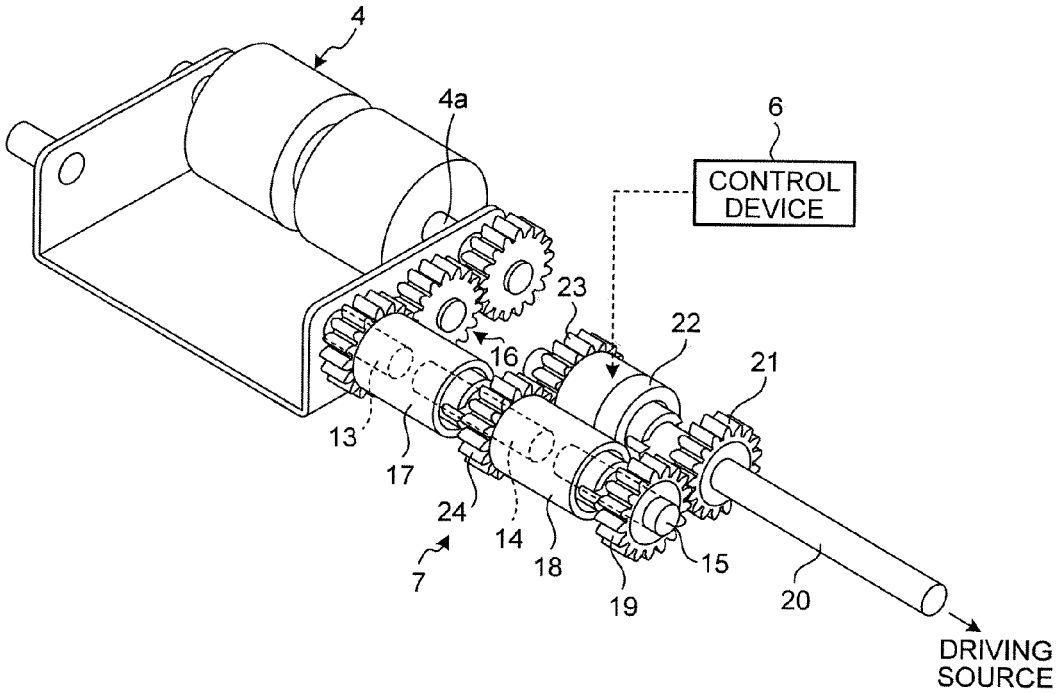
FIG. 2 is a perspective view that illustrates a schematic configuration of a separating power generating device in FIG. 1.

A first embodiment of the present invention is described with reference to FIGS. 1 and 2. FIG. 1 is a cross-sectional view that illustrates a schematic configuration of a medium feeding device according to the first embodiment of the present invention, and FIG. 2 is a perspective view that illustrates a schematic configuration of a separating power generating device in FIG. 1.

Referring to FIG. 1, the schematic configuration of the medium feeding device of the present embodiment is described first.

As illustrated in FIG. 1, a medium feeding device 1 according to the present embodiment is a device which separates one medium S1, at a time, as a transportation target from a plurality of sheet-like media S sucked on a hopper 8, and supplies it in a conveying direction. The medium feeding device 1 is applied to, for example, an automatic paper feed mechanism (Auto Document Feeder: ADF) mounted in image reading apparatuses, such as an image scanner, a copying machine, a facsimile, and a character recognizing device, or image forming apparatuses, such as a printer. Examples of the sheet-like media S include sheet-like reading objects, such as manuscripts and business cards, and sheet-like to-be-recorded media, such as print sheets and sheets of paper.

The medium feeding device 1 includes a pickup roller 2, a feeding roller 3, a brake roller 4, and a transporting roller 5 on a transportation path along which the media S are conveyed in the conveying direction, and further includes a control device 6. The medium feeding device 1 illustrated in FIG. 1 is a medium feeding device of an upper extraction type which feeds, as a transportation target, the uppermost medium S1 from among a plurality of media S stacked on the hopper 8.

The pickup roller 2 is a roller for sending out the plurality of media S stacked on the hopper 8 in the conveying direction. The pickup roller 2 is formed in a cylindrical shape in which an inner layer thereof is made of a soft material, such as, rubber foam so that a nip width may be easily formed. The pickup roller 2 is configured to be able to rotate on a rotating shaft thereof which is arranged in a direction substantially orthogonal to the conveying direction. On the upstream side of a feed gate 9 in the conveying direction which is provided at a lower end portion of the hopper 8, the pickup roller 2 is arranged so that the circumferential surface thereof can come into contact with the upper surface of the media S stacked on the hopper 8. The feed gate 9 is a member which regulates the number of sheets entering into the downstream side thereof in the conveying direction among the media S loaded on the hopper 8. As the rotating shaft of the pickup roller 2 is driven to rotate along with operation of a motor 10 controlled by the control device 6 and comes into contact with the media S from above, the pickup roller 2 can send out the media S in the conveying direction.

The feeding roller 3 is a roller for dispatching in the conveying direction the medium S1, which is the top layer of one sheet and is a transportation target, among the media S sent out by the pickup roller 2. The feeding roller 3 is formed in a cylindrical shape in which an inner layer thereof is made of a soft material, such as, rubber foam so that a nip width may be easily formed. The feeding roller 3 is configured to be able to rotate on a rotating shaft thereof which is arranged in a direction substantially orthogonal to the conveying direction. On the downstream side of the feed gate 9 in the conveying direction, the feeding roller 3 is arranged so that the circumferential surface thereof can come into contact with the medium S1 from above the medium S1. As the rotating shaft of the feeding roller 3 is driven to rotate along with operation of a motor 11 controlled by the control device 6 and comes into contact with the medium S1 from above, the feeding roller 3 can convey the medium S1 as the transportation target in the conveying direction. The conveying direction is indicated by arrow C in FIG. 1.

The brake roller 4 is a roller for preventing media S2 from being dispatched in the conveying direction, where the media S2 is other than the medium S1 of one sheet serving as the transportation target, among the media S sent out by the pickup roller 2. The brake roller 4 is formed in a cylindrical shape in which an inner layer thereof is made of a soft material, such as rubber foam so that a nip width may be easily formed. The brake roller 4 is configured to be able to rotate on a rotating shaft 4*a* thereof which is arranged in a direction substantially orthogonal to the conveying direction.

The brake roller 4 is provided so as to face the feeding roller 3, and is in pressure contact with the feeding roller 3. In this embodiment, "pressure contact" means the state of pressing with arbitrary contact pressure. Because of the state of the contact pressure, a nip, which is a contact surface of both of the rollers, is formed between the brake roller 4 and the feeding roller 3. The medium S1 passes through the nip between the feeding roller 3 and the brake roller 4, and is fed to the downstream side in the conveying direction. The nip width, which is the length of the nip in the conveying direction, is adjustable according to the degree of the contact pressure of the brake roller 4 against the feeding roller 3.

The brake roller 4 receives torque of the conveying direction from the feeding roller 3 side due to the frictional force between itself and the feeding roller 3 or between itself and the media S. When the torque received from the feeding roller 3 side is equal to or larger than a predetermined torque of driven rotation, the brake roller 4 is idled in the conveying direction indicated by arrow A in FIG. 1, and is able to rotate along with the rotation of the feeding roller 3. When the torque received from the feeding roller 3 side is smaller than the torque of driven rotation, the brake roller 4 is driven to rotate in a direction indicated by arrow B in FIG. 1, that is, a direction counter to the conveying direction, due to a driving force transferred from a driving source (not shown), thereby generating rotational load. In other words, the rotational load generated by the brake roller 4 is limited to the torque of driven rotation which serves as an upper limit value.

When the brake roller 4 is in direct contact with the feeding roller 3, or when only the medium S1 of one sheet has entered into the nip, since a relatively large frictional force is generated between itself and the feeding roller 3 or between itself and the medium S1 and the brake roller 4 receives the torque equal to or larger than the torque of driven rotation, the brake roller 4 rotates along with the rotation of the feeding roller 3. On the other hand, when the double feed occurs, that is, when the medium S1 as the transportation target and the medium S2 under the medium S1 enter into the nip together, the frictional force between itself and the media S1 and S2 becomes relatively small and the torque received from the feeding roller 3 side becomes smaller than the torque of driven rotation. Therefore, the rotational load of the direction counter to the conveying direction is generated. With this rotational load, the separating power to separate the medium S2 from the medium S1 in the direction counter to the conveying direction is applied to the medium S2 which has entered the nip, so that the medium S2 may move in the direction counter to the conveying direction unlike the medium S1, and thus may be separated from the medium S1. With this operation, only the medium S1 as the transportation target is sent out from the nip and the other medium S2 stays in the nip. As a result, the medium S2, which is not the medium S1 of one sheet serving as the transportation target, is prevented from being dispatched in the conveying direction.

The function of the brake roller 4 configured in the manner described above is achieved due to a separating power generating device 7 (a rotational load generating unit) connected to the rotating shaft 4*a* of the brake roller 4. The separating power generating device 7 is configured to be able to change the rotational load of the brake roller 4 in multiple stages. The separating power generating device 7 changes a set value of the torque of driven rotation according to the instructions from the control device 6 when the control device 6 receives a rotational load changing command by accepting operator's operation. When the separating power generating device 7 has changed the torque of driven rotation, the magnitude of the rotational load generated by the brake roller 4 changes.

For example, when torque of driven rotation is increased, the rotational load also increases; and when torque of driven rotation decreases, the rotational load also decreases. The specific configuration of the separating power generating device 7 is described below.

The transporting roller 5 is arranged at the downstream side of the feeding roller 3 in the conveying direction, and further conveys downstream the medium S1 which has passed the feeding roller 3 in the conveying direction. The transporting roller 5 includes a driving roller driven to rotate by a motor 12, and a driven roller which rotates along with the rotation of the driving roller by being in pressure contact with the driving roller. The medium S1 passes between the driving roller and the driven roller so as to be conveyed downstream in the conveying direction.

The control device 6 controls each unit of the medium feeding device 1. As illustrated in FIG. 1, the control device 6 is connected to the motors 10, 11, and 12, and controls each rotation of the pickup roller 2 to which the motor 10 is connected, the feeding roller 3 to which the motor 11 is connected, and the transporting roller 5 to which the motor 12 is connected.

The control device 6 is connected to the separating power generating device 7 (rotational load generating unit). For example, when a command of changing the operational load of the brake roller 4 is received by the input of the operator's operation, the control device 6 will perform control of changing the rotational load of the brake roller 4, by controlling the separating power generating device 7 according to this command.

After receiving the command of changing the rotational load of the brake roller 4, the control device 6 may suitably adjust the timing for actually changing the torque of driven rotation, so that the rotational load of the brake roller 4 may be changed smoothly during the feeding operation of the medium S. For example, a configuration may be considered in which the rotational load is changed after a predetermined period of time elapses after having determined to change the rotational load. Alternatively, another configuration also may be considered in which the rotational load may be changed after a prescribed period elapses, after having determined to change the rotational load and immediately before the medium S which is started to be conveyed enters the feeding roller 3.

Physically, the control device 6 is a computer which includes a CPU (Central Processing Unit), RAM (Random Access Memory), and ROM (Read Only Memory). All or a part of each function of the control device 6 described above is realized in a manner that application programs retained in the ROM are loaded into the RAM and then executed by the CPU and, as a result data is read out of and/or written in the RAM and/or ROM.

Next, referring to FIG. 2, the configuration of the separating power generating device 7 is described.

The separating power generating device 7 includes a shaft 13, a shaft 14, and a shaft 15, which are arranged substantially in parallel with the rotating shaft 4*a* of the brake roller 4. The shaft 13, the shaft 14, and the shaft 15 are concentrically arranged. The shaft 13 is connected to the rotating shaft 4*a* of the brake roller 4 via a gear train 16 so as to be able to transmit power.

A torque limiter 17 (first load generating unit) is provided between the shaft 13 and the shaft 14, and a torque limiter 18 (second load generating unit) is provided between the shaft 14 and the shaft 15. That is, the torque limiter 17 and the torque limiter 18 are concentrically arranged in series.

A gear 19 is pivotally supported by the shaft 15. A gear 21 pivotally supported by a shaft 20, which are arranged in parallel with the shaft 13, the shaft 14, and the shaft 15, meshes with the gear 19. At the opposite end of the brake roller 4 with respect to the gear 21, the shaft 20 is connected to a driving source, such as a motor (not shown).

That is, a power transmission path from the driving source to the brake roller 4 is formed by the shaft 20, the gear 21, the gear 19, the shaft 15, the torque limiter 18, the shaft 14, the torque limiter 17, the shaft 13, and the gear train 16. The driving source is configured in a manner to enable the brake roller 4 to rotate in the direction counter to the conveying direction via the power transmission path so that the driving power may be generated.

The torque limiter 17 arranged on the power transmission path is directly connected to the brake roller 4, and restricts transmission of power between the shaft 13 and the shaft 14 to a predetermined upper limit torque T1 (first torque). That is, when the torque equal to or larger than the upper limit torque T1 is applied to the shaft 13 or the shaft 14, the torque limiter 17 interrupts the transmission of power between the shaft 13 and the shaft 14. The expression "the torque limiter 17 is directly connected to the brake roller 4" expresses the configuration in which a component concerning control of the transmission of power such as another torque limiter and a clutch is not interposed, but only a power transmitting element such as a gear is provided, on the connection path between the torque limiter 17 and the brake roller 4.

On the power transmission path, the torque limiter 18 is arranged in series with the torque limiter 17, and restricts the transmission of power between the shaft 14 and the shaft 15 to a predetermined upper limit torque T2 (second torque). That is, when the torque equal to or larger than the upper limit torque T2 is applied to the shaft 14 or the shaft 15, the torque limiter 18 interrupts the power transmission between the shaft 14 and the shaft 15. The upper limit torque T2 of the torque limiter 18 is set to be smaller than the upper limit torque T1 of the torque limiter 17.

The separating power generating device 7 further includes an electromagnetic clutch 22 (switching unit).

The electromagnetic clutch 22 is pivotally supported on a portion nearer to the brake roller 4 than the gear 21 of the shaft 20. The electromagnetic clutch 22 has a gear 23, and enables and disables the transmission of power between the gear 23 and the shaft 20 according to the instructions from the control device 6. When the electromagnetic clutch 22 is in ON state, the gear 23 engages with the shaft 20, so that the gear 23 and the shaft 20 integrally rotate. When the electromagnetic clutch 22 is in OFF state, the gear 23 disengages from the shaft 20, so that transmission of power between the gear 23 and the shaft 20 is interrupted. The gear 23 of the electromagnetic clutch 22 engages with a gear 24 pivotally supported by the shaft 14.

That is, during the ON state, the electromagnetic clutch 22 allows the transmission of power between the shaft 20 and the gear 23, and between the gear 24 and the shaft 14, and can form a bypass route which bypasses the torque limiter 18 on the power transmission path. The electromagnetic clutch 22 can switch between connection and disconnection between the bypass route and the power transmission path by engagement and disengagement of the gear 23 and the shaft 20.

Since the gear 24 of the shaft 14, with which the gear 23 of the electromagnetic clutch 22 meshes, is arranged between the torque limiter 17 and the torque limiter 18, the electromagnetic clutch 22 is connected to a portion closer to the torque limiter 17 side rather than the torque limiter 18 on the power transmission path. The shafts 14 and 15, with which the torque limiter 18 is concentric, and the shaft 20, with which the electromagnetic clutch 22 is concentric, are arranged in parallel with each other as described above. Moreover, the gear 24, which is adjacent to the torque limiter 18 on the side of the brake roller 4, and the gear 23, which is on the side of the brake roller 4 of the electromagnetic clutch 22, meshes with each other. Accordingly, the torque limiter 18 and the electromagnetic clutch 22 are arranged in parallel with each other.

Because of the separating power generating device 7 having such a configuration, the rotational load of the brake roller 4 can be changed in stages.

When the electromagnetic clutch 22 is controlled to enter the ON state so that the gear 23 engages with the shaft 20, the bypass route which bypasses the torque limiter 18 is connected to the power transmission path so that the power from the driving source is transmitted via the bypass route. Accordingly, regardless of the transmission and non-transmission of the power by the torque limiter 18, the power from the driving source is transmitted from the driving source side up to the shaft 14. Then, at the torque limiter 17, the switch between transmission and non-transmission of the power to the brake roller 4 is made, depending on whether the torque received by the torque limiter 17 is equal to or less than the upper limit torque T1. That is, when the electromagnetic clutch 22 is in ON state, the torque of driven rotation of the brake roller 4 is set to the upper limit torque T1 of the torque limiter 17, and the rotational load of the brake roller 4 becomes the upper limit torque T1.

On the other hand, when the electromagnetic clutch 22 is controlled to be in OFF state so that the gear 23 disengages from the shaft 20, transmission of the power from the driving source via the bypass route is interrupted. Accordingly, transmission and non-transmission of the power supplied from the driving source to the brake roller 4 side is switched at the torque limiter 18, depending on whether the torque received by the torque limiter 18 is equal to or less than the upper limit torque T2. That is, when the electromagnetic clutch 22 is in OFF state, the torque of driven rotation of the brake roller 4 is set to the upper limit torque T2 of the torque limiter 18, and the rotational load of the brake roller 4 becomes the upper limit torque T2.

As described above, the separating power generating device 7 includes the torque limiters 17 and 18 for which two different upper limit torques T1 and T2 are set, respectively, and one electromagnetic clutch 22. In addition, the rotational load of the brake roller 4 can be changed in two stages, that is, the upper limit torque T1 of the torque limiter 17 and the upper limit torque T2 of the torque limiter 18 which is smaller than upper limit torque T1, by the switching between engagement and disengagement of the electromagnetic clutch 22.

Hereinbelow, the advantages of the medium feeding device according to the present invention are described with reference to the drawings.

The medium feeding device 1 of the present embodiment includes the feeding roller 3 which conveys the medium S1 in the conveying direction, the brake roller 4 arranged to be in pressure contact with the feeding roller 3, and the separating power generating device 7 which is connected to the brake roller 4 and causes the brake roller 4 to generate the rotational load exerting in the direction counter to the conveying direction. The separating power generating device 7 includes the torque limiter 17 which is directly connected to the brake roller 4 and generates a load of a predetermined upper limit torque T1, the torque limiter 18 which is arranged in series with the torque limiter 17 on the power transmission path to transmit the rotational load to the brake roller 4 and generates a load of an upper limit torque T2 smaller than the upper limit torque T1, and the electromagnetic clutch 22 that is connected to the side of the torque limiter 17 rather than the torque limiter 18 on the power transmission path, and switches between connection and disconnection between the power transmission path and the bypass route which bypasses the torque limiter 18. The separating power generating device 7 can change the rotational load of the brake roller 4 to the upper limit torque T1 or to upper limit torque T2, by the switching of the electromagnetic clutch 22.

With this configuration, the rotational load of the brake roller 4 can be changed to the upper limit torque T1 of the torque limiter 17, or to the upper limit torque T2 of the torque limiter 18, by switching between the ON state and the OFF state of the electromagnetic clutch 22 of the separating power generating device 7. Accordingly, the rotational load of the brake roller 4 can be changed.

In the conventional technology which allows the change in the rotational load of a brake roller, an electromagnetic brake with relatively large inertia was used as a component to change the rotational load. On the other hand, since the medium feeding device 1 of the present embodiment uses the torque limiters 17 and 18 with relatively smaller inertia compared with the electromagnetic brake, as means to change the rotational load, the influence of the inertia decreases, and a response at the time when the rotational load for the brake roller 4 is generated improves. As a result, even at a higher medium conveying speed, the brake roller can generate the rotational load promptly when a double feed occurs. This secures sufficient performance of separating the medium S1 as the transportation target from the other media S2.

As described above, the medium feeding device 1 of the present embodiment can change the rotational load of the brake roller 4 and at the same time secure sufficient performance of separating the medium S1 as the transportation target from the other media S2 even when the medium conveying speed is increased.

Here, the relation between the medium conveying speed (roller rotational speed) and the inertia is described. Suppose the situation in which a rotating body, which is rotating, abruptly stops. At this time, an angle of rotation (hereinafter, referred to as a required stop angle), which will be needed until the rotating body stops rotating, can be expressed by the relation of the following Formula (1), based on the rotational speed and the inertia of the rotating body.

$$(\text{angle of rotation})^2 \times (\text{inertia}) \propto (\text{required stop angle}) \quad (1)$$

That is, in order to double the speed to maintain the same stop performance, it is necessary to reduce the inertia to ¼.

Taking into the above-mentioned Formula (1), the present embodiment to which the two torque limiters 17 and 18 are applied, and the conventional technology to which the electromagnetic brake is applied are compared with each other in order to confirm the difference in the influence of the inertia therebetween. When each of the inertia and torque of the electromagnetic brake is assumed to be 1 as a reference value, it is assumed that the inertia and torque of the torque limiter 18 are ⅓ and 1, respectively, and the inertia and torque of the torque limiter 17 are ⅓ and ¾, respectively. At this time, the rotational load torque which can be generated by the brake roller 4 is chosen to be 1 or ¾ in the present embodiment. When the torque of 1 is chosen, the inertia is ⅓ only in consideration of the torque limiter 17. On the other hand, when the torque of ¾ is chosen, the inertia is ⅔ in consideration of both the torque limiters 17 and 18. In this case, according to the above-mentioned Formula (1), the present embodiment can maintain the required stop angle of the brake roller 4 even when the medium conveying speed is increased to 1.22 times compared with the conventional technology to which the electromagnetic brake is applied. Therefore, as compared with the conventional technology, the medium feeding device 1 of the present embodiment can further increase the medium conveying speed.

Since the medium feeding device 1 of the present embodiment employs a relatively cheap mechanical torque limiter as a component as a component which changes the rotational load of the brake roller 4, an increase in cost can be suppressed.

In the medium feeding device 1 of the present embodiment, the electromagnetic clutch 22 and the torque limiter 18 are arranged in parallel. With this configuration, the total length in the axial direction of the shafts 13, 14, and 15 of the separating power generating device 7 or the shaft 20 can be reduced. This contributes to the space saving of the medium feeding device 1.

Second Embodiment

Figure 3:
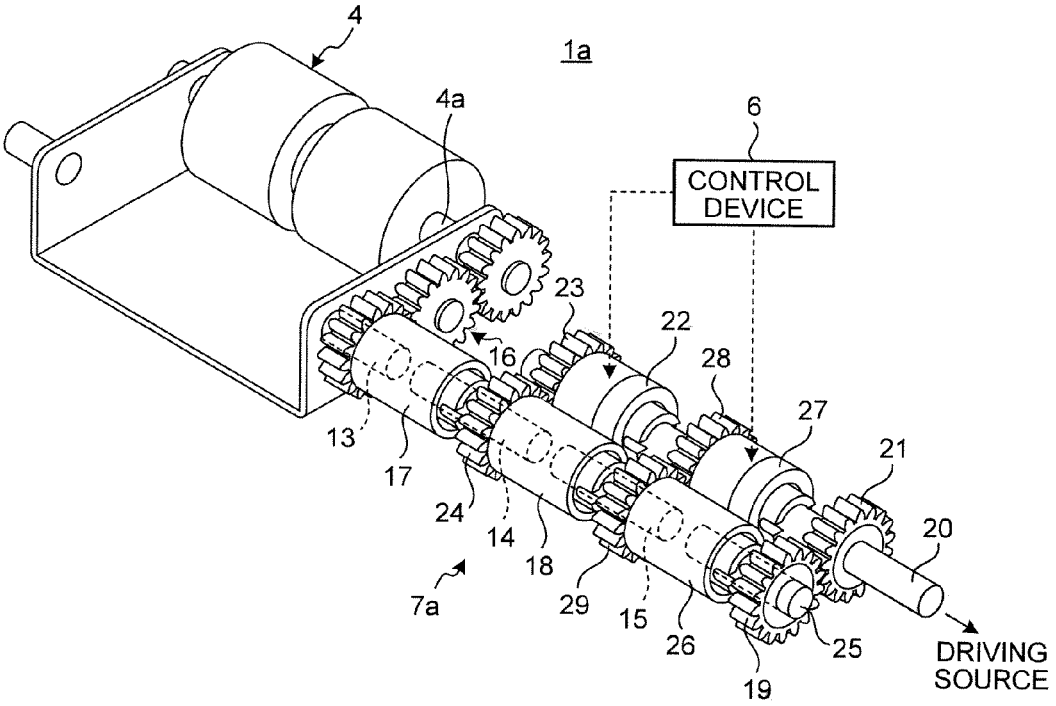
FIG. 3 is a perspective view that illustrates a schematic configuration of a separating power generating device provided for a medium feeding device according to a second embodiment of the present invention.

Next, a second embodiment of the present invention is described with reference to FIG. 3. FIG. 3 is a perspective view illustrating the schematic configuration of a separating power generating device in a medium feeding device according to the second embodiment of the present invention.

As illustrated in FIG. 3, a medium feeding device 1*a* of the present embodiment is different from the medium feeding device 1 of the first embodiment in that a separating power generating device 7*a* includes three torque limiters 17, 18, and 26 and two electromagnetic clutches 22 and 27.

The separating power generating device 7*a* further includes a shaft 25 concentrically in addition to a shaft 13, a shaft 14 and a shaft 15. A gear 19 is pivotally supported by the shaft 25. The torque limiter 26 (second load generating unit) is provided between the shaft 15 and the shaft 25. That is, the torque limiter 17, the torque limiter 18, and the torque limiter 26 are concentrically arranged in series. That is, a power transmission path from a driving source to a brake roller 4 is formed by a shaft 20, a gear 21, the gear 19, the shaft 25, the torque limiter 26, the shaft 15, the torque limiter 18, the shaft 14, the torque limiter 17, the shaft 13, and a gear train 16.

The torque limiter 26 is arranged in series with the torque limiter 18 on the power transmission path and is arranged in series even with the torque limiter 17. The torque limiter 26 restricts the transmission of power between the shaft 15 and the shaft 25 to a predetermined upper limit torque T3 (second torque). That is, when the torque equal to or larger than the upper limit torque T3 is applied to the shaft 15 or the shaft 25, the torque limiter 26 interrupts the transmission of power between the shaft 15 and the shaft 25.

The upper limit torque T3 of the torque limiter 26 is set to be smaller than the upper limit torque T2 of the torque limiter 18. That is, the relation among the magnitudes of the upper limit torques T1, T2, and T3 of the three torque limiters 17, 18, and 26 is set to be T1>T2>T3.

The separating power generating device 7*a* further includes the electromagnetic clutch 27 (switching unit).

The electromagnetic clutch 27 is pivotally supported between the gear 21 of the shaft 20 and the electromagnetic clutch 22. That is, the electromagnetic clutch 22 and the electromagnetic clutch 27 are concentrically arranged in series.

The electromagnetic clutch 27 has a gear 28, and enables and disables the transmission of power between the gear 28 and the shaft 20 according to the instructions from the control device 6 like the electromagnetic clutch 22. The gear 28 engages with a gear 29 pivotally supported by the shaft 15. When in ON state, the electromagnetic clutch 27 enables the transmission of power between the shaft 20 and the gear 28 and between the gear 29 and the shaft 15, and can form a bypass route which bypasses the torque limiter 26 on the power transmission path. The electromagnetic clutch 27 can switch between connection and disconnection between the bypass route and the power transmission path, by engagement and disengagement of the gear 28 and the shaft 20.

The electromagnetic clutch 27 is connected to the torque limiter 17 side rather than the torque limiter 26 on the power transmission path, and more particularly is connected between the torque limiter 18 and the torque limiter 26. The torque limiter 26 and the electromagnetic clutch 27 are arranged in substantially parallel with each other.

The separating power generating device 7*a* can be expressed as a configuration in which, on the power transmission path, the separating power generating device 7*a* includes a plurality of sets of the torque limiters 18 and 26, for which the upper limit torques T2 and T3 smaller than the upper limit torque T1 of the torque limiter 17 are respectively set, and the electromagnetic clutches 22 and 27 which switch between connection to and disconnection from the bypass route for bypassing the torque limiters 18 and 26. In other words, the separating power generating device 7*a* can be expressed as a configuration in which the set of the torque limiter 18 and the electromagnetic clutch 22 and the set of the torque limiter 26 and the electromagnetic clutch 27 are arranged on the power transmission path from the brake roller 4 side to the driving source side, in descending order of the value of the upper limit torques T2 and T3.

Because of the separating power generating device 7 having such a configuration, the rotational load of the brake roller 4 can be changed in stages.

When the electromagnetic clutch 22 was controlled to enter the ON state so that the gear 23 engages with the shaft 20, the bypass route, which bypasses the torque limiter 18 and the torque limiter 26, is connected to the power transmission path so that the power from the driving source is transmitted via the bypass route. Accordingly, regardless of the transmission and non-transmission of the power by the torque limiter 18 and the torque limiter 26, the power from the driving source is transmitted from the driving source side up to the shaft 14. Then, in the torque limiter 17, the switch between transmission and non-transmission of power up to the brake roller 4 is made, depending on whether the torque received by the torque limiter 17 is equal to or less than the upper limit torque T1. That is, when the electromagnetic clutch 22 is in ON state, the torque of driven rotation of the brake roller 4 is set to the upper limit torque T1 of the torque limiter 17, and the rotational load of the brake roller 4 becomes the upper limit torque T1.

When the electromagnetic clutch 22 is controlled to enter the OFF state so that the gear 23 disengages from the shaft 20, and when the electromagnetic clutch 27 is controlled to enter the ON state so that the gear 28 engages with the shaft 20, the bypass route, which bypasses the torque limiter 26, is connected to the power transmission path so that the power from the driving source is transmitted via the bypass route. Accordingly, regardless of the transmission and non-transmission of the power by the torque limiter 26, the power from the driving source is transmitted from the driving source up to the shaft 15. Then, the torque limiter 18 switches between transmission and non-transmission of the power to the brake roller 4, depending on whether the torque received by the torque limiter 18 is equal to or less than the upper limit torque T2. That is, when the electromagnetic clutch 22 is in OFF state and the electromagnetic clutch 27 is in ON state, the torque of driven rotation of the brake roller 4 is set to the upper limit torque T2 of the torque limiter 18 and the rotational load of the brake roller 4 becomes the upper limit torque T2.

When the electromagnetic clutch 22 is controlled to enter the OFF state so that the gear 23 disengages from the shaft 20, and when the electromagnetic clutch 27 is controlled to enter the OFF state so that the gear 28 disengages from the shaft 20, the transmission of the power from the driving source via the bypass route is interrupted. Accordingly, the torque limiter 26 switches between transmission and non-transmission of the power from the driving source to the brake roller 4, depending on whether the torque received by the torque limiter 26 is equal to or less than the upper limit torque T3. That is, when the electromagnetic clutch 22 is in OFF state and the electromagnetic clutch 27 is also in OFF state, the torque of driven rotation of the brake roller 4 is set to the upper limit torque T3 of the torque limiter 26 and the rotational load of the brake roller 4 becomes the upper limit torque T3.

As described above, the separating power generating device 7*a* includes the torque limiters 17, 18, and 26, for which three different upper limit torques T1, T2, and T3 are set, and the two electromagnetic clutches 22 and 27. Moreover, the rotational load of the brake roller 4 can be changed to three stages T1, T2, and T3, where T1 is the upper limit torque of the torque limiter 17, T2 is the upper limit torque of the torque limiter 18 which is smaller than T1, and T3 is the upper limit torque of the torque limiter 26 which is smaller than T2, according to the switching between engagement and disengagement of the electromagnetic clutches 22 and 27.

Thus, in the medium feeding device 1*a* of the present embodiment, the separating power generating device 7*a* includes a plurality of sets of electromagnetic clutches 22, 27 and torque limiters 18, 26, on the path of the power transmission system. For the torque limiters 18 and 26, different values of the upper limit torques T2 and T3 are set, respectively. The set of the electromagnetic clutch 22 and the torque limiter 18, and the set of the electromagnetic clutch 27 and the torque limiter 26 are arranged from the brake roller 4 side to the driving source side in descending order of the values of the upper limit torques of T2 and T3. That is, the arrangement is made in order of the torque limiter 17, the electromagnetic clutch 22 and the torque limiter 18, and the electromagnetic clutch 27 and the torque limiter 26.

With this configuration, the electromagnetic clutches 22 and 27 of the separating power generating device 7*a* are separately switched between the ON state and the OFF state. Therefore, the rotational load of the brake roller 4 can be changed to the upper limit torque T1 of the torque limiter 17, the upper limit torque T2 of the torque limiter 18, or the upper limit torque T3 of the torque limiter 26. The rotational load of the brake roller 4 can be changed in multiple stages, and the rotational load can be more suitably set for each of a variety of media S.

Moreover, the separating power generating device 7*a* may include an additional set of a torque limiter and an electromagnetic clutch. The torque of driven rotation of added torque limiters may differ from those of the other torque limiters 18 and 26, and those torque limiters are arranged in descending order of the value of the upper limit torque, which is set for each torque limiter, on the power transmission path from the brake roller 4 side to the driving source side. This enables the change in the rotational load of the brake roller 4 in four or more stages, so that the rotational load can be much more optimally set.

Third Embodiment

Figure 4:
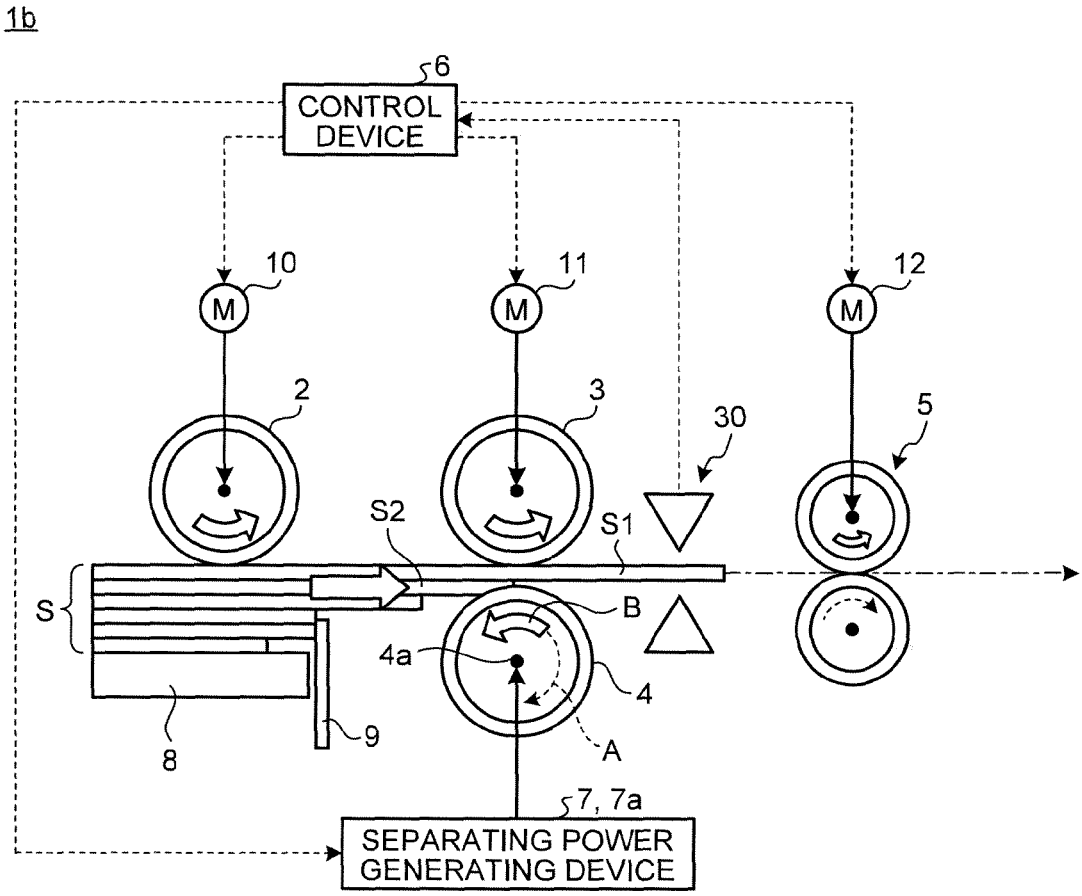
FIG. 4 is a cross-sectional view that illustrates a schematic configuration of a medium feeding device according to a third embodiment of the present invention.
Figure 5:
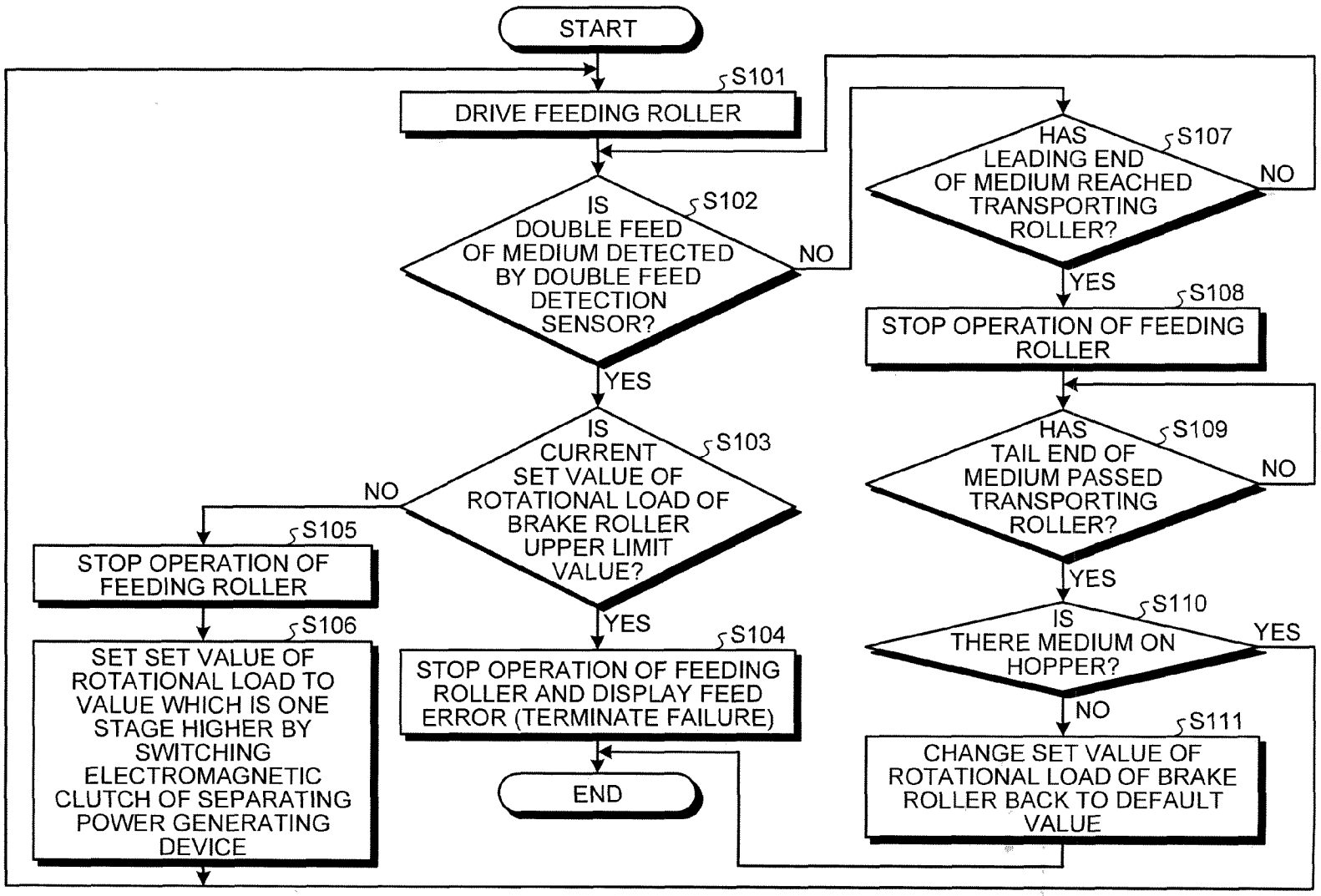
FIG. 5 is a flowchart that illustrates processing of changing a rotational load of a brake roller in the third embodiment of the present invention.

Next, a third embodiment of the present invention is described with reference to FIGS. 4 and 5. FIG. 4 is a sectional view illustrating the schematic configuration of a medium feeding device according to the third embodiment of the present invention. FIG. 5 is a flowchart illustrating processing of changing rotational load of a brake roller in the third embodiment of the present invention.

As illustrated in FIG. 4, a medium feeding device 1*b* of the present embodiment is different from the medium feeding device 1 of the first embodiment and the medium feeding device 1*a* of the second embodiment in that the medium feeding device 1*b* is equipped with a double feed detection sensor 30 (double feed detection unit) which detect a double feed of media S from a brake roller 4 to the downstream side in a conveying direction, and in that when the double feed of the media S is detected by the double feed detection sensor 30, the control device 6 controls the separating power generating device 7 or 7*a* so that the rotational load of the brake roller 4 may increase.

A pair of the double feed detection sensors 30 is arranged at both sides of the transportation path of the medium S1, and faces each other along a thickness direction of the medium S1. In addition, when the media S pass through between the sensors facing each other, the sensors detect that two or more media S are conveyed overlapping. The double feed detection sensors 30, having detected the double feed of the media S, transmit the information of the effect to the control device 6.

When the double feed of the media S is detected by the double feed detection sensors 30, it means a state in which the media S of two or more sheets are sent out downstream in the conveying direction, from a nip between the feeding roller 3 and the brake roller 4. In order to solve this state, the control device 6 controls the separating power generating device 7 or 7*a* so that the torque of driven rotation of the brake roller 4 may be increased according to a result of the detection of the double feed by the double feed detection sensors 30. In this way, the rotational load of the brake roller 4 increases, and thus stronger separating power can be applied to the media S2 other than a transportation target, which are entering the nip between the feeding roller 3 and the brake roller 4. This may promote separation of the media S2 from the medium S1 as the transportation target.

Referring to FIG. 5, the schematic configuration of the medium feeding device 1*b* of the present embodiment is described first.

The feeding roller 3 is activated first (S101), and the feeding roller 3 sends out the media S to the downstream side in the conveying direction. When the leading ends of the media S sent out from the feeding roller 3 reach the detection range of the double feed detection sensors 30, the double feed detection sensors 30 will check whether there is an overlap of a plurality of media S (S102).

When an overlap of the media S is detected in Step S102 (Yes in Step S102), it is subsequently checked whether a current set value of the rotational load of the brake roller 4 is an upper limit value (S103). When the current set value of the rotational load of the brake roller 4 is the upper limit value (Yes in Step S103), it is assumed that the double feed of the media S has occurred even if the rotational load of the brake roller 4 is set at the maximum. Assuming that a certain failure has occurred in the medium feeding device 1*b*, the operation of the feeding roller 3 is suspended. A feed error is presented to an operator. This terminates the failure (S104).

When the current set value of the rotational load of the brake roller 4 is not the upper limit value (No in Step S103), in order to suppress the double feed of the medium S, the operation of the feeding roller 3 is suspended (S105). The switching between the electromagnetic clutches 22 and 27 of the separating power generating devices 7 or 7*a* raises the set value of the rotational load of the brake roller 4 to a value one stage higher (S106). Then the processing returns to Step S101. For example, in the case of the separating power generating device 7*a* illustrated in FIG. 3, when the current rotational load is set at the upper limit torque T3 of the torque limiter 26, the electromagnetic clutch 22 is controlled to enter the OFF state and the electromagnetic clutch 27 is controlled to enter the ON state. This changes the torque of driven rotation of the brake roller 4 to the upper limit torque T2. As a result, the rotational load of the brake roller 4 is changed to the upper limit torque T2. When the current rotational load is set at the upper limit torque T2 of the torque limiter 18, the electromagnetic clutch 22 is controlled to enter the ON state and the torque of driven rotation of the brake roller 4 is changed to the upper limit torque T1. As a result, the rotational load of the brake roller 4 is changed to the upper limit torque T1.

When an overlap of the media S is not detected in Step S102 (No in Step S102), it is subsequently checked whether the leading end of the medium S1 has reached the transporting roller 5 (S107). When the medium S1 has not reached the transporting roller 5 (No in Step S107), the processing returns to Step S102.

When the medium S1 has reached the transporting roller 5 in Step S107 (Yes in Step S107), the drive of the feeding roller 3 is suspended (S108) and the medium S1 is conveyed downstream by the transporting roller 5. Standing by until the tail end of the medium S1 passes the transporting roller 5 (No in Step S109), after the tail end of the medium S1 has passed the transporting roller 5 (Yes in Step S109), it is checked whether there are other media S on a hopper 8 (S110). When there are the media S on the hopper 8 (Yes in Step S110), the processing returns to Step S101. When there is no medium S on the hopper 8 (No in Step S110), the set value of the rotational load of the brake roller 4 is changed back to a default value (S111), and the processing ends.

The flowchart of FIG. 5 illustrates, for example, a configuration in which, after sending out all the media S on the hopper 8, the set value of the rotational load of the brake roller 4 is changed back to the default value. However, another configuration may be employed in which the set value of the rotational load is changed back to the default value at another timing, for example, after a prescribed period passes, or after a predetermined number of medium S is conveyed. Alternatively, a further configuration may also be considered in which the changed set value of the rotational load is stored without being changed back to the default value at the time of the end of the rotational load change processing illustrated in FIG. 5, and the stored set value of the rotational load is used at the time of executing next rotational load change processing.

Fourth Embodiment

Figure 6:
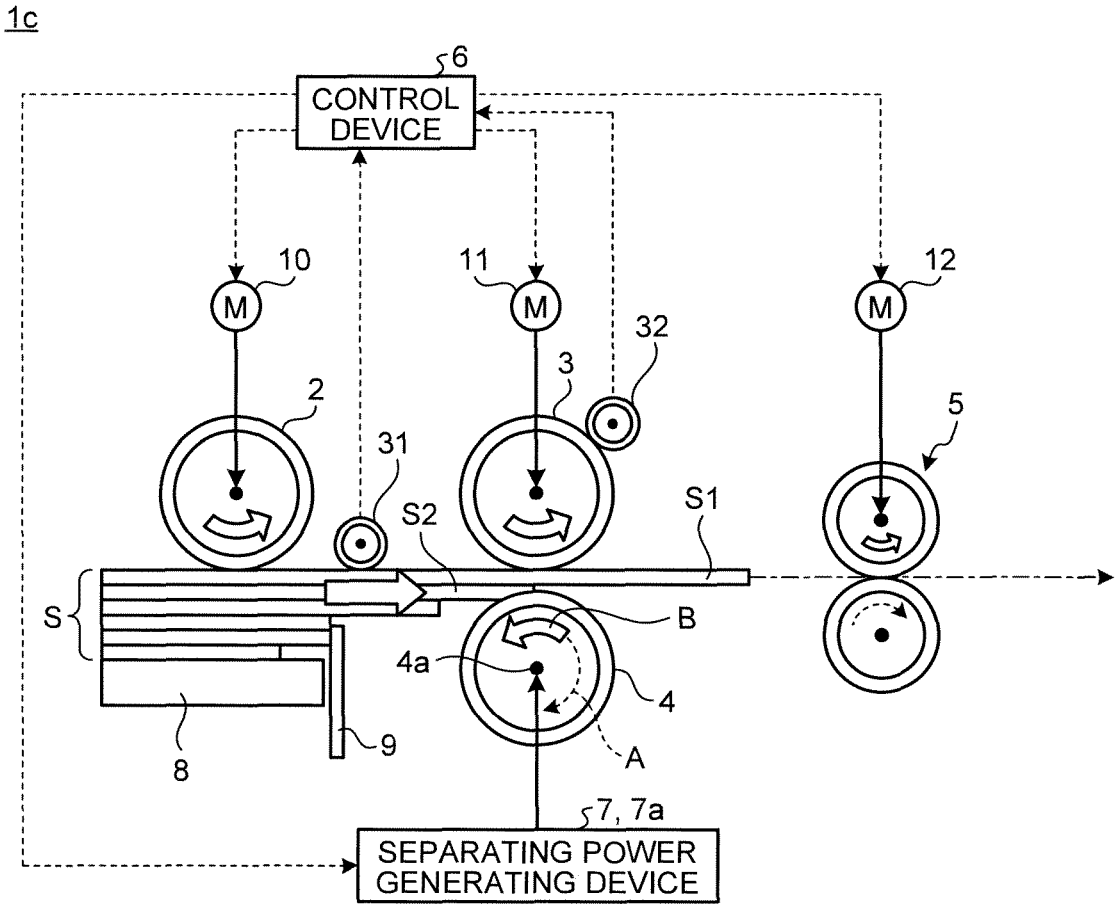
FIG. 6 is a cross-sectional view that illustrates a schematic configuration of a medium feeding device according to a fourth embodiment of the present invention.
Figure 7:
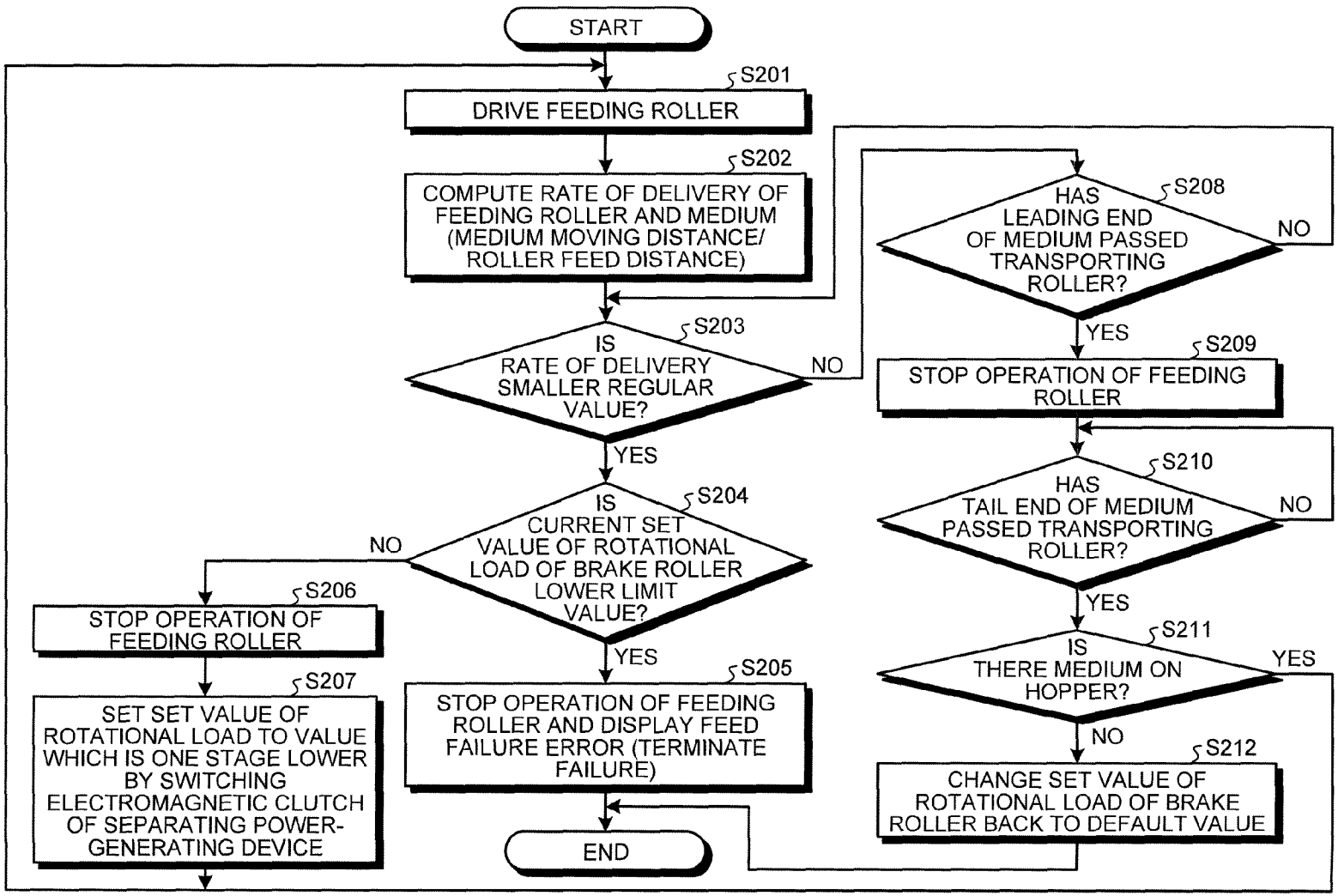
FIG. 7 is a flowchart that illustrates processing of changing a rotational load of a brake roller in the fourth embodiment of the present invention.

Next, a fourth embodiment of the present invention is described with reference to FIGS. 6 and 7. FIG. 6 is a sectional view illustrating the schematic configuration of a medium feeding according to the fourth embodiment of the present invention. FIG. 7 is a flowchart illustrating processing of changing the rotational load of a brake roller in the fourth embodiment of the present invention.

As illustrated in FIG. 6, a medium feeding device 1*c* of the present embodiment differs from the medium feeding device 1 of the first embodiment, the medium feeding device 1*a* of the second embodiment, and the medium feeding device 1*b* of the third embodiment in that the medium feeding device 1*c* is equipped with an encoder 31 for detecting a moving distance of a medium S1 which enters a feeding roller 3 and an encoder 32 for detecting a feed distance of the feeding roller 3, and in that a control device 6 performs control of changing the rotational load of a brake roller 4, based on a ratio of the feed distance of the feeding roller 3 and the moving distance of the medium S1 which enters the feeding roller 3.

The encoder 31, for example, is arranged between a pickup roller 2 and the feeding roller 3, and measures the amount of movement of the medium S1 sent out by the pickup roller 2 toward the feeding roller 3. The encoder 32, for example, is arranged to be in contact with the circumferential surface of the feeding roller 3 and measures the feed per rotation of the feeding roller 3 by rotating along with the rotation of the feeding roller 3.

The control device 6 computes the rate of delivery of the feeding roller 3 and the medium S1 (medium moving distance/roller feed distance of a feeding roller), based on the amount of movement of the medium S1 measured by the encoder 31 and the feed per rotation of the feeding roller 3 measured by the encoder 32. When this rate of delivery is less than 1, it means a state in which sliding is occurring between the feeding roller 3 and the medium S1. When the rate of delivery is smaller than a prescribed value less than 1, the control device 6 assumes that the rotational load of the brake roller 4 is excessive and the conveyance of the medium S1 by the feeding roller 3 is inhibited, and thus controls a separating power generating device 7 or 7*a* so that the torque of driven rotation of the brake roller 4 may be reduced. In this way, the rotational load of the brake roller 4 can be changed to an appropriate value, which can suppress the sliding between the feeding roller 3 and the medium S1.

Referring to FIG. 7, the schematic configuration of the medium feeding device 1*c* of the present embodiment is described first.

The feeding roller 3 is activated first (S201) to send out media S to the downstream side in the conveying direction. At this time, the encoder 31 measures the amount of movement (medium moving distance) of a medium S1 which is sent out toward the feeding roller 3 from the pickup roller 2, while the encoder 32 measures the feed per rotation (roller feed distance) of the feeding roller 3. Based on these measurement values, the rate of delivery of the feeding roller 3 and the medium S1 (medium moving distance/roller feed distance) is computed (S202).

Then, it is checked whether the rate of delivery computed in Step S202 is smaller than the prescribed value less than 1 (S203). When the rate of delivery is smaller than the prescribed value (Yes in Step S203), it is subsequently checked whether a current set value of the rotational load of the brake roller 4 is a lower limit value (S204). When the current set value of the rotational load of the brake roller 4 is the lower limit value (Yes in Step S204), it is assumed that sliding more than allowable has occurred between the feeding roller 3 and the medium S1 even if the rotational load of the brake roller 4 is set to the minimum. Assuming that a certain failure has occurred in the medium feeding device 1*c*, the operation of the feeding roller 3 is suspended and a feed error is presented to an operator. As a result, the failure is terminated (S205).

When the current set value of the rotational load of the brake roller 4 is not the lower limit value (No in Step S204), in order to suppress the sliding between the feeding roller 3 and the medium S1, the operation of the feeding roller 3 is suspended (S206). The switching between the electromagnetic clutches 22 and 27 of the separating power generating devices 7 or 7*a* sets the set value of the rotational load of the brake roller 4 to a value one stage lower (S207). Then the processing returns to Step S201. For example, in the case of the separating power generating device 7*a* illustrated in FIG. 3, when the current rotational load is set to the upper limit torque T1 of the torque limiter 17, the electromagnetic clutch 22 is controlled to enter the OFF state and the electromagnetic clutch 27 is controlled to enter the ON state, which changes the torque of driven rotation of the brake roller 4 to the upper limit torque T2. As a result, the rotational load of the brake roller 4 is changed to the upper limit torque T2. When the current rotational load is set to the upper limit torque T2 of the torque limiter 18, the electromagnetic clutch 22 is controlled to enter the OFF state and the electromagnetic clutch 27 is controlled to enter the OFF state, which changes the torque of driven rotation of the brake roller 4 to the upper limit torque T3. As a result, the rotational load of the brake roller 4 is changed to the upper limit torque T3.

When the rate of delivery is equal to or larger than the prescribed value in Step S203 (No in Step S203), it is subsequently checked whether the leading end of the medium S1 has reached a transporting roller 5 (S208). When the medium S1 has not reached the transporting roller 5 (No in Step S208), the processing returns to Step S203.

When the medium S1 has reached the transporting roller 5 in Step S208 (Yes in Step S208), the drive of the feeding roller 3 is suspended (S209) and the medium S1 is conveyed downstream by the transporting roller 5. Standing by until the tail end of the medium S1 passes the transporting roller 5 (No in Step S210), after the tail end of the medium S1 has passed the transporting roller 5 (Yes in Step S210), it is checked whether there are other media S on a hopper 8 (S211). When there are the media S on the hopper 8 (Yes in Step S211), the processing returns to Step S201. When there is no medium S on the hopper 8 (No in Step S211), the set value of the rotational load of the brake roller 4 is changed back to a default value (S212). Then the processing ends.

The flowchart of FIG. 7 illustrates, for example, a configuration in which, after sending out all the media S on the hopper 8, the set value of the rotational load of the brake roller 4 is changed back to the default value. However, another configuration may be employed in which the set value of the rotational load is changed back to the default value at another timing, for example, after a prescribed period passes or after a predetermined number of medium S is conveyed. Alternatively, a further configuration also may be considered in which the changed set value of the rotational load is stored without being changed back to the default value at the time of the end of the rotational load change processing illustrated in FIG. 7, and the stored set value of the rotational load is used at the time of executing next rotational load change processing.

The flowchart of FIG. 7 illustrates an exemplary configuration in which, when the rate of delivery is smaller than a prescribed value, the set value of the rotational load of the brake roller 4 is set to a value one stage lower. However, another configuration may be considered in which, when the rate of delivery is larger than the prescribed value, the rotational load is set to a value one stage higher.

The above-mentioned embodiment describes, for example, a medium feeding device of the type which includes a driving source such as a motor, which causes a brake roller 4 to rotate in a conveying direction and a counter direction, i.e., a medium feeding device of an FRR system. However, as long as the rotational load can be generated for the brake roller 4, techniques other than the FRR system such as a technique of a simple FRR system may be applied, where in the simple FRR system the rotating shaft 4*a* of the brake roller 4 does not rotate in the direction counter to the conveying direction. The separating power generating devices 7 and 7*a* may have a configuration in which no driving source such as a motor is equipped and the shaft 20 connected to the driving source is fixed to a fixed end so as not to be rotatable.

In the above-described embodiments, the separating power generating devices 7 and 7*a* are configured such that the electromagnetic clutches 22 and 27 are arranged in parallel with the torque limiters 18 and 26. However, they may be arranged concentrically in series with the torque limiters. For example, the torque limiter 18 and the electromagnetic clutch 22 illustrated in FIG. 2 may be configured such that the electromagnetic clutch 22 and the gear 23 are arranged on the shaft 14 between the torque limiter 17 and the torque limiter 18, and the gear 24 is arranged on the shaft 20.

Moreover, in the above-described embodiments, although the separating power generating devices 7 and 7*a* are configured such that a plurality of torque limiters 17, 18, and 26 is arranged concentrically in series, at least part of the torque limiters may be arranged on the shaft 20 which is arranged in parallel therewith. For example, with respect to the torque limiter 18 and the electromagnetic clutch 22 illustrated in FIG. 3, the electromagnetic clutch 22 and the gear 23 are arranged concentrically between the torque limiter 17 and the torque limiter 26, and the torque limiter 18 and the gear 24 are pivotally supported by the shaft 20 and are arranged in parallel with the electromagnetic clutch 22.

In addition, the above-described embodiments describe the medium feeding device of the upper extraction type which feeds, as a transportation target, the uppermost medium S1 among the media S stacked on the hopper 8. The present invention is also applicable to the type which supplies, as the transportation target, the lowermost medium among a plurality of media S stacked on the hopper 8, that is, the so-called lower extraction type of medium feeding device.

Moreover, in the above-described embodiment, the torque limiters 17, 18, and 26 are used as components to change the rotational load of the brake roller 4. Elements other than the torque limiters may be used, as long as the elements have small inertia as compared with the conventional components which change the rotational load such as an electromagnetic brake, and can restrict the transmission of power to below a predetermined torque.

The medium feeding device according to the embodiments of the present invention has the advantages that the device is capable of changing a rotational load of the brake roller and securing sufficient performance of separating a medium as a transportation target from the other media even when the medium conveying speed is increased.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed:

1. A medium feeding device comprising:

a feeding roller that conveys a medium in a conveying direction;

a brake roller arranged to be in pressure contact with the feeding roller; and a rotational load generating unit that is connected to the brake roller and causes the brake roller to generate a rotational load in a direction counter to the conveying direction, the rotational load generating unit comprising:

a first load generating unit that is directly connected to the brake roller and generates a load of a first predetermined torque based on a driving power generated by a driving source;

a second load generating unit that is arranged in series with the first load generating unit on a power transmission path along which the rotational load is transmitted to the brake roller, and that generates a load of a second torque smaller than the first torque; and a switching unit that is connected to the first load generating unit side rather than the second load generating unit side on the power transmission path and switches between connection and disconnection between the power transmission path and a bypass route which bypasses the second load generating unit, wherein the rotational load of the brake roller can be changed to the first torque or the second torque by the switching of the switching unit.

2. The medium feeding device according to claim 1, wherein the rotational load generating unit further comprises an additional set of switching unit and second load generating unit on the power transmission path, wherein the additional second load generating unit has an additional value for an additional second torque thereof, the additional value for the additional second torque being different from the value of the second torque, and wherein the sets of the switching unit and second load generating unit and additional switching unit and second load generating unit are arranged in descending order of the values of the second torque and the additional second torque from the brake-roller side to the driving source side.

3. The medium feeding device according to claim 1, wherein the switching unit and the second load generating unit are arranged in parallel with each other.

4. The medium feeding device according to claim 1, wherein after the rotational load has been determined to be changed, the rotational load generating unit changes the rotational load in a prescribed period of time.

5. The medium feeding device according to claim 1, wherein after the rotational load has been determined to be changed, the rotational load generating unit changes the rotational load immediately before a medium, for which conveyance is about to be started, enters the feeding roller in a prescribed period of time.

6. The medium feeding device according to claim 1, further comprising a double feed detecting unit that is provided downstream of the brake roller in the conveying direction and detects a double feed of the medium, wherein the rotational load generating unit increases the rotational load when the double feed detecting unit has detected a double feed.

7. The medium feeding device according to claim 1, wherein the rotational load generating unit changes the rotational load, based on a ratio between a feed distance of the feeding roller and a moving distance of the medium that enters into the feeding roller.

* * * * *